US007107004B2

(12) United States Patent
Saito

(10) Patent No.: US 7,107,004 B2
(45) Date of Patent: Sep. 12, 2006

(54) COMPACTLY ARRANGED IMAGE FORMING APPARATUS

(75) Inventor: Takashi Saito, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 119 days.

(21) Appl. No.: 10/822,800

(22) Filed: Apr. 13, 2004

(65) Prior Publication Data

US 2004/0228650 A1 Nov. 18, 2004

(30) Foreign Application Priority Data

May 9, 2003 (JP) ..... 2003-132023

(51) Int. Cl.
*G03G 15/00* (2006.01)

(52) U.S. Cl. ..... 399/405; 399/407

(58) Field of Classification Search ..... None
See application file for complete search history.

(56) References Cited

U.S. PATENT DOCUMENTS 6,263,185 B1 * 7/2001 Kato et al. ..... 399/381
6,408,147 B1 * 6/2002 Oshida ..... 399/82
6,522,862 B1 * 2/2003 Koshimizu et al. ..... 399/405
6,735,415 B1 * 5/2004 Isobe et al. ..... 399/410
6,851,668 B1 * 2/2005 Mui et al. ..... 271/3.17
6,898,395 B1 * 5/2005 Mui et al. ..... 399/107
2003/0044209 A1 * 3/2003 Isobe et al. ..... 399/410

FOREIGN PATENT DOCUMENTS

JP 2002-60118 2/2002
JP 2002-111935 4/2002

* cited by examiner

*Primary Examiner*—Robert Beatty
(74) *Attorney, Agent, or Firm*—Manabu Kanesaka

(57) ABSTRACT

An image forming apparatus includes an image forming unit for forming an image on a sheet; a sheet finishing unit arranged above the image forming unit for performing a finishing process such as punching a hole, stapling and marking on the sheet; and an image reading unit arranged above the sheet finishing unit for scanning and reading an image on an original set on a platen. The image forming unit includes a first discharge stacker having a first sheet discharge device, and the sheet finishing unit includes a second discharge stacker having a second sheet discharge device. The first sheet discharge device discharges the sheet in a direction same as a direction that the second sheet discharge device discharges the sheet. The image reading unit scans the sheet in a direction substantially perpendicular to the direction that the first and second sheet discharge devices discharge the sheet.

10 Claims, 6 Drawing Sheets

COMPACTLY ARRANGED IMAGE FORMING APPARATUS

BACKGROUND OF THE INVENTION AND RELATED ART STATEMENT

The present invention relates to an image forming apparatus such as a copier, printer or facsimile machine. More particularly, the present invention relates to an image forming apparatus equipped with an image forming unit for printing an image on a sheet medium; an image reading unit for reading an image on an original using photoelectric means; and a sheet finishing unit for binding, opening a hole or marking a sheet discharged from the image forming unit. In the image forming apparatus, the sheet finishing unit is arranged above the image forming unit, and the image reading unit is arranged above the sheet finishing unit.

Generally, an image forming apparatus has been known as a copier in which an image reading unit reads an original and an image forming unit produces a copy of the original, or known as a facsimile machine for transmitting an original read by an image reading unit. In recent years, an image forming apparatus has been connected to a computer network as an input/output terminal so that an image forming unit thereof prints data from an external source, or has been used as an input device for sending data read by the image reading unit to a computer.

When the image reading apparatus is used either as a single function device, i.e. a stand-alone unit, or as an I/O terminal in a computer network, it is necessary to perform a finishing process such as binding, opening a hole, or marking on sheets discharged from the image forming unit. The present invention relates to an image forming unit equipped with a sheet finishing unit for automatically finishing sheets.

As business machines such as computers have become compact, there has been a growing demand for an image forming apparatus equipped with an image forming unit, sheet finishing unit and image reading unit to be compact and lower cost as well as capable of handling a variety of sheet media with small to large sizes. There have been proposed and widely used conventional image forming devices in which a sheet finishing unit is arranged above an image forming unit, and an image reading unit is arranged above the sheet finishing unit for making the device small and saving a space.

As shown in FIG. 5, Japanese Patent Publication (Kokai) No. 2002-60118 has disclosed an apparatus in which a sheet finishing unit 530 is arranged above an image forming unit 510 and an image reading unit 520 is arranged above the sheet finishing unit 530. In the image forming unit 510, similar to a normal printer, a sheet stacked on a sheet cassette 511 is guided to a transfer drum 512 and a latent image formed on a transfer drum 512 is transferred to the sheet according to a signal from an image data processing unit. Then, the sheet is transported through a fixer 515, and is discharged through a discharge path 514. The sheet finishing unit 530 is arranged at an edge of an outlet of the discharge path 514 so that the stapling apparatus 532 staples the sheet stacked on the discharge stacker 531.

The image reading unit 520 is arranged above the sheet finishing unit, so that a carriage 524 moves from left to right for reading an original set on a platen glass 522 similar to a conventional scanner. The carriage 524 is provided with a mirror and a light source (not shown). The light source irradiates the original, and the reflected light passes through a lens and is converted into an electrical signal with a photoelectric conversion element such as a CCD 523 to read the image on the original. The electrical signal from the photoelectric conversion element is converted into a digital signal and transmitted to an image data processing unit 513 in the image forming unit 510, so that the image forming unit 510 prints the image.

As shown in FIG. 6, Japanese Patent Publication (Kokai) No. 2002-111935 has disclosed an apparatus in which a sheet finishing unit 630 is arranged above an image forming unit 610, and an image reading unit 620 is arranged above the sheet finishing unit 630. A sheet is transported from a sheet supply cassette 611, and stored on a first discharge stacker 632 after a transfer drum 612 forms an image on the sheet. When a finishing process is instructed, the sheet is stored on a second discharge stacker 631 and a device such as a stapler (not shown) performs a finishing process. The image reading unit 620 moves from left to right for reading the original set on a platen 612.

In the apparatuses disclosed in Japanese Patent Publications (Kokai) No. 2002-60118 and No. 2002-111935, an automatic document feeder can be mounted on the image reading unit as an optional device for feeding the original stacked on the stacker to the discharge stacker through a substantially U-shaped path.

As described above, in the conventional apparatus, the image reading unit is arranged above the sheet finishing unit and the image forming unit is arranged below the sheet finishing unit. In this case, after an image is formed on a sheet in the image forming unit, the sheet is transported in a direction same as a direction that the sheet is transported after being processed in the sheet finishing unit, and same as a direction that the image reading unit scans the sheet. Accordingly, there are the following problems in order to make the apparatus compact.

The sheet normally used has a longitudinal length different from a lateral length (width). When a sheet with the maximum size is transported for image forming, finishing and scanning in a direction same as the longitudinal direction thereof, it is necessary to dispose a function component such as a binding device of the sheet finishing unit, a driving component for driving the function component, and a drive component such as a transport roller for transporting the sheet at sides of the sheet finishing unit, thereby making the sheet finishing unit protrude laterally and increasing a width thereof. Further, it is necessary to provide a mechanism for removing the function component in the sheet finishing unit when a worn out part is replaced or maintenance is performed upon malfunction, thereby further increasing the width of the sheet finishing unit.

In view of the problems described above, a first object of the present invention is to provide an image forming apparatus having a compact size with small protrusions in which a sheet is discharged from an image forming unit in a direction same as a direction that the sheet is discharged from a sheet finishing unit and an image reading unit scans the sheet in a direction substantially perpendicular to the direction that the sheet is discharged.

A second object of the present invention is to provide an image forming apparatus in which it is easy to confirm a sheet stored on a discharge tray in the image forming unit or the sheet finishing unit arranged vertically from a same direction.

Further objects and advantages of the invention will be apparent from the following description of the invention.

SUMMARY OF THE INVENTION

According to a first aspect of the present invention, an image forming apparatus is configured such that a sheet (maximum size sheet) is discharged from an image forming unit in a direction same as and overlapped a direction that the sheet is discharged from a sheet finishing unit. In the image forming apparatus, an image reading unit scans the sheet (maximum size sheet) in a direction perpendicular to the direction that the sheet is discharged from the image forming unit. Accordingly, a functional component is disposed in the sheet finishing unit without protruding outside, and it is possible to confirm the sheet from a same direction.

More specifically, according to the first aspect of the present invention, the image forming apparatus includes the image forming unit for forming an image on a sheet; the sheet finishing unit arranged above the image forming unit for performing a finishing process such as punching a hole, stapling and marking on the sheet discharged from the image forming unit; and the image reading unit arranged above the sheet finishing unit for scanning and reading an image on an original set on a platen. The image forming unit includes a first discharge stacker having first sheet discharge means, and the sheet finishing unit includes a second discharge stacker having second sheet discharge means. The first sheet discharge means discharges the sheet in a direction same as a direction that the second sheet discharge means discharges the sheet. The image reading unit scans the sheet in a direction substantially perpendicular to the direction that the first and second sheet discharge means discharge the sheet.

In the image forming apparatus with the configuration described above, the image forming unit, the sheet finishing unit and the image reading unit are arranged vertically, so that a function component such as a stapler can be arranged at left and right sides of the sheet finishing unit (left and right in the sheet discharge direction) within a space that does not protrude from the image reading unit.

According to a second aspect of the present invention, the image reading unit is arranged in a position shifted relative to the first discharge stacker and the second discharge stacker toward a backside in the sheet discharge direction. Accordingly, it is easy to confirm the sheet stored in the first or second discharge stacker as the image reading unit partially covers the sheet, and it is easy to remove the sheet.

According to a third aspect of the present invention, the image forming unit, the sheet finishing unit and the image reading unit are housed in different casings. Accordingly, it is possible to freely arrange the units with different functions as necessary.

According to a fourth aspect of the present invention, finishing means of the sheet finishing unit is arranged on one of the left and right sides of the second discharge stacker, and drive means of the sheet discharge means is arranged on the other of the left and right sides. That is, for example, the finishing means such as a stapler is arranged on the left side, and the drive means such as a drive motor is arranged on the right side, thereby reducing a size of the apparatus.

According to a fifth aspect of the present invention, a mounting member is provided for mounting the image reading unit on the sheet finishing unit. Accordingly, it is possible to arrange the image forming unit, the sheet finishing unit and the image reading unit vertically overlapped with each other.

According to a sixth aspect of the present invention, the mounting member is provided with a side supporting member extending from the sheet finishing unit toward the backside in the sheet discharge direction. Accordingly, it is possible to firmly mount the image reading unit in a position shifted relative to the sheet finishing unit toward the backside of the sheet discharge direction.

According to a seventh aspect of the present invention, the mounting member includes a flat portion for mounting the sheet finishing unit and at least two stem portions connected to the flat portion. The stem portions are attached to a frame of the image forming unit, thereby eliminating an effect of a weight of the image reading unit on the sheet finishing unit.

According to an eighth aspect of the present invention, the image reading unit is provided with a sheet feeding unit for feeding the sheet in a direction same as a direction that the image reading unit scans the sheet. With this configuration, the sheet discharge direction of the image forming unit is aligned with the sheet discharge direction of the sheet finishing unit. Accordingly, it is possible to arrange the image reading unit and the original feeding unit perpendicular to the sheet discharge direction, so that it is easy to handle the sheet and the original. It is also possible to shift the image reading unit and the sheet feeding unit relative to the image forming unit and sheet finishing unit toward the backside in the sheet discharge direction.

According to a ninth aspect of the present invention, an image forming apparatus includes an image forming unit for forming an image on a sheet; a sheet finishing unit arranged above the image forming unit for finishing such as punching a hole, stapling or marking the sheet discharged from the image forming unit; and an image reading unit arranged above the sheet finishing unit for scanning an image on an original set on a platen. The image forming unit includes a first discharge stacker having first sheet discharge means, and the sheet finishing unit includes a second discharge stacker having a second sheet discharge means. The first sheet discharge means discharges the sheet in a direction same as a direction that the second sheet discharge means discharges the sheet. The image reading unit scans the sheet in a direction substantially perpendicular to the direction that the first and second sheet discharge means discharge the sheet. The image reading unit is arranged in a position shifted relative to the first discharge stacker and the second discharge stacker toward a backside in the sheet discharge direction.

DETAILED DESCRIPTION OF PREFERRED EMBODIMENTS

Figure 1:
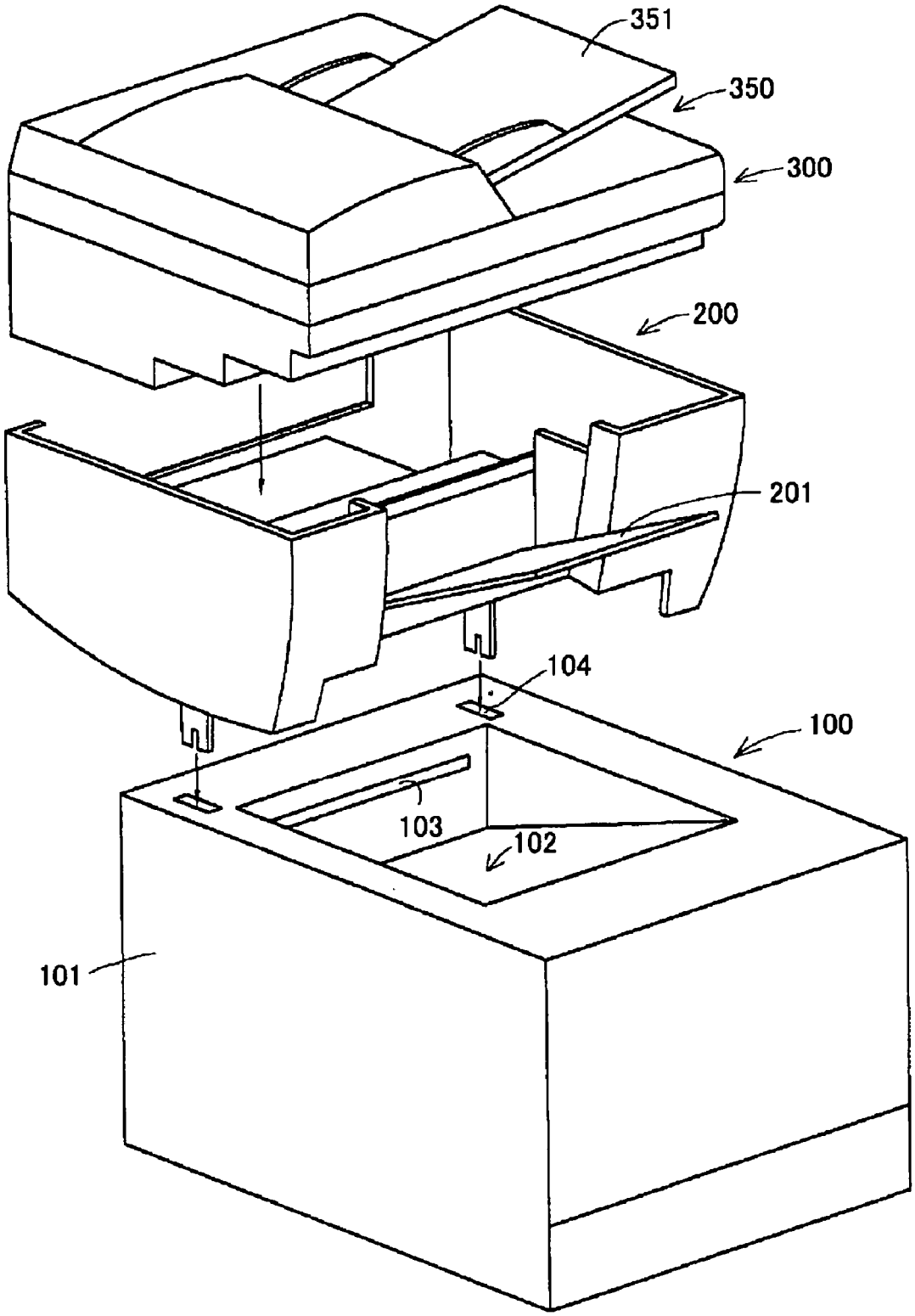
FIG. 1 is an explanatory perspective view of an image forming apparatus according to an embodiment of the present invention.
Figure 2:
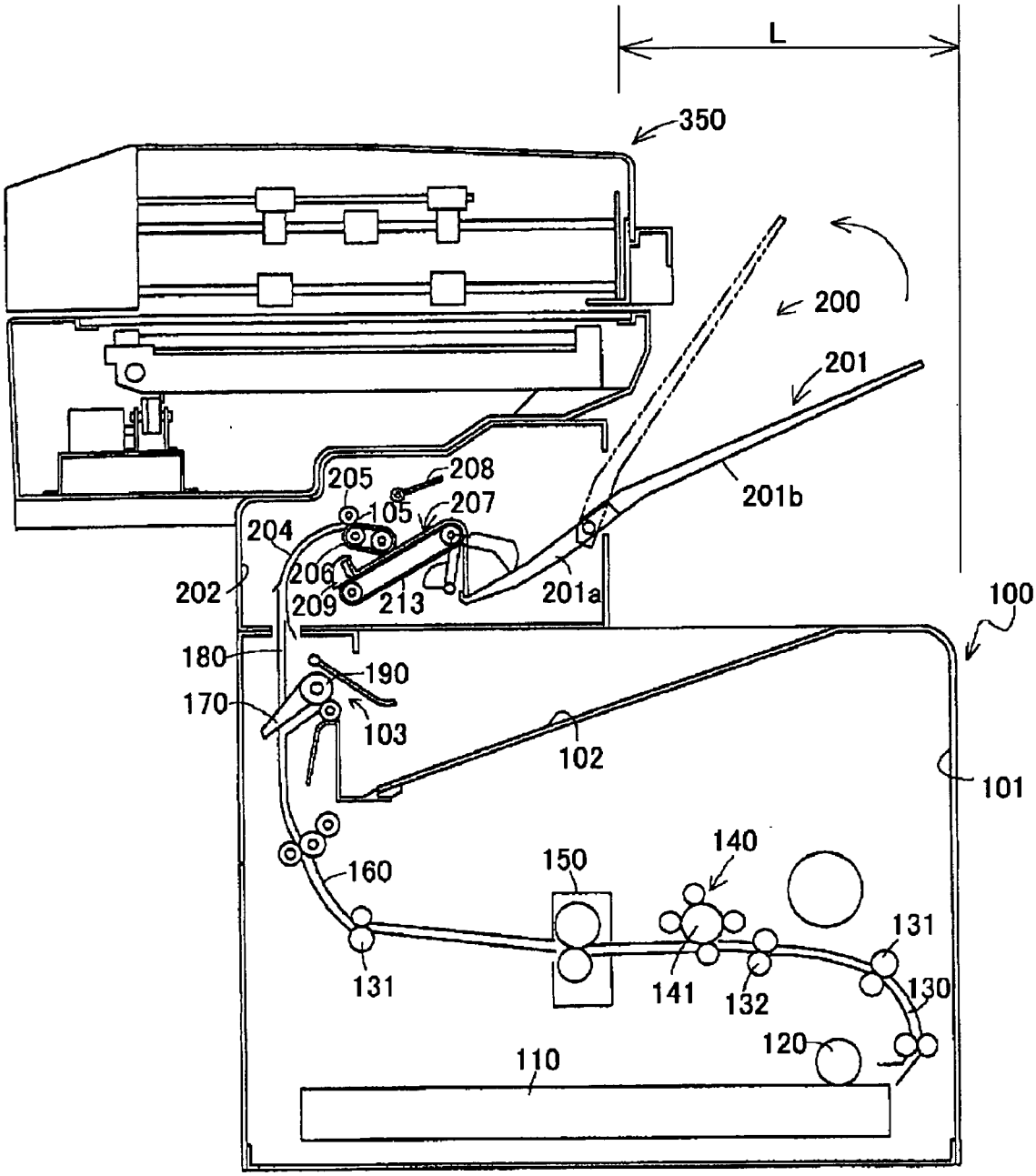
FIG. 2 is a longitudinal sectional view of the image forming apparatus according to the embodiment of the present invention.

Hereunder, embodiments of the instant invention will be described in detail with reference to the accompanying drawings. FIG. 1 is a perspective view of an image reading apparatus according to an embodiment of the present invention. FIG. 2 is a longitudinal sectional view thereof.

An image forming unit 100, a sheet finishing unit 200 and an image reading unit 300 are stored in casings. Depending on an application, for example, when the apparatus is used as a printer connected to a computer (not shown), the image forming unit 100 is used alone. When a finishing function such as a stapler (for binding sheets) is necessary, the image forming unit is combined with the sheet finishing unit 200. When the apparatus is used as a copier, the image reading unit 300 is combined.

The image forming unit 100 comprises a casing 101 having a proper shape; a sheet cassette 110; a printing unit 140; fixing rollers 150; a first discharge stacker 102; and a transport path 130 extending from the sheet cassette 110 to the first discharge stacker 102.

The first discharge stacker 102 is formed in a tray shape integrated with the casing 101 for stacking and storing sheets. Reference numeral 103 represents a sheet discharge outlet for discharging the sheets (described below), and reference numeral 104 represents a mounting hole of the sheet finishing unit 200 (described below). The sheet cassette 110 is formed in a tray shape for stacking and storing the sheets, and is detachably retained in the casing 101.

The sheet cassette 110 may be a combination of a plurality of cassettes stacked vertically in a plurality of levels. The maximum size sheets are stored so that a longitudinal direction thereof is aligned with the left to right direction in FIG. 2. Smaller sizes sheets are stored so that a longitudinal direction or a lateral direction thereof is aligned with the left to right direction in FIG. 2. Accordingly, the maximum size sheets are stored in the sheet cassette along the longitudinal direction thereof, and transported in the longitudinal direction for printing. An image forming mechanism such as a sheet feeding mechanism and printing mechanism is arranged in the width direction of the maximum size sheets, thereby making the apparatus small and low cost.

The sheet cassette 110 is provided with a sheet feed roller 120 at a leading end thereof in the sheet feeding direction, so that the sheet feed roller touches the upper most sheet stored in the cassette. The sheet feed roller 120 rotates in the counterclockwise direction in FIG. 2 to sequentially draw the sheets out toward the transport path 130. A corner pawl (not shown) is disposed in the sheet cassette 110 in addition to the sheet feed roller 120, so that only the uppermost sheet is separated and drawn out from the cassette when the sheet feed roller 120 rotates. When the maximum size sheet is drawn out from the sheet feed cassette 110, the sheet is fed in the longitudinal direction (for a small size sheet, in the longitudinal direction or lateral direction) to the transport path 130. The transport roller 131 is arranged to guide the sheet into the printing unit 140. The register rollers 132 are disposed before the printing unit 140 for aligning the leading edge of the sheet to remove skew.

The printing unit 140 is arranged on the sheet transport path 130. The printing unit 140 may have a structure for static electricity printing, thermal transfer printing or any other printing methods. In the embodiment, the printing unit 140 has a configuration for static electricity printing.

A photosensitive drum 141 is formed of a photosensitive body (material) for forming a static latent image corresponding to an image formed by a laser beam generator (not shown). A developer dispenses toner ink over the static latent image, and the image is transferred to the sheet when the sheet is fed over the transport path 130. A fixing roller 150 applies heat to the sheet to fix the toner ink, and the sheet is fed to a discharge path 160.

The discharge path 160 is provided with two paths branched to a first discharge outlet 103 and a second discharge outlet 105. A switching gate 170 selects one of the first discharge outlet 103 and the second discharge outlet 105. The first discharge outlet 103 is connected to the first discharge stacker 102; and the second discharge outlet 105 is connected to the second discharge stacker 201. The first discharge stacker 102 is integrated with the casing 101 of the image forming unit 100. A pair of discharge rollers 190 is disposed at the discharge outlet 103. As shown in FIGS. 1 and 2, the first and second discharge stackers 102 and 201 are disposed vertically in a same direction aligned with the longitudinal direction of the maximum size sheet. The discharge means (discharge roller 190) on the first discharge stacker 102 discharges the sheet along the discharge stacker 102 in a direction same as a direction that the discharge means (discharge roller 205) on the second discharge stacker 201 discharges the sheet along the discharge stacker 201.

Accordingly, the sheets are transported through the discharge path 160 to the first discharge stacker 102 in the longitudinal direction of the maximum size sheet, and stored in the first discharge stacker 102. It is preferred that the sheet transport path 130 and the discharge path 160 extending from the sheet cassette 110 to the first discharge stacker 102 have an S-shape section as shown in FIG. 2, so that the apparatus is made small.

The switching gate 170 is disposed in the discharge path 160 for guiding the sheet to the discharge outlet 103 or the discharge outlet 105. As shown in FIG. 2, the switching gate 170 is provided with drive means (not shown) such as a solenoid, so that the switching gate 170 moves in the counterclockwise direction to guide the sheet to the second discharge outlet 105 according to a signal from an apparatus control unit (described below).

The sheet finishing unit 200 is disposed at the second discharge outlet 105, and has the following structure. The sheet finishing unit 200 is configured as a unit combining a alignment tray 207, a second discharge stacker 201 and finishing means 216 in the casing 202. The second discharge stacker 201 is arranged vertically in the same direction relative to the first discharge stacker 102. The discharge stacker 201 is configured of a base portion 201*a* integrated with the casing 202, and a leading end portion 201*b* mounted on a bearing of the base portion 201*a* to be rotatable in the up and down directions in FIG. 2. It is configured such that the leading end portion 201*b* rotates from a state indicated by solid lines in FIG. 2 to a state indicated by hidden lines, so that it is easy to remove the sheet from the first discharge stacker 102 especially in a case of sheet jam. It is also possible to reduce a vertical gap between the first discharge stacker 102 and the second discharge stacker 201.

The sheets with an image formed thereupon are stored on the first discharge stacker 102, and the sheet finishing unit 200 is provided for finishing the sheets. The finishing function includes a jogging function for sorting the sheets into a set of the sheets, a stapling function for binding the sheets into a set of the sheets, a punching function for punching holes into the sheets, or a marking function for applying a predetermined mark on the sheets. The apparatus may be provided with a single function or a combination of the functions.

There are well known mechanisms for the finishing processes. Only a stapling mechanism will be explained, but not limited to the mechanism. In the embodiment, a sheet flow path 204 connected to the discharge path 160 of the image forming unit 100 is disposed in the sheet finishing unit 200. A pair of discharge rollers 205 and 206 is disposed in the discharge path 105 of the sheet flow path 204. The discharge roller 206 is composed of an endless belt for stacking the sheets on the alignment tray 207. A paddle 208 formed of a soft rubber rotates clockwise in FIG. 2 to align the trailing edge of the sheets on the alignment tray 207. The sheets are transported through the discharge outlet 105, and the trailing edges thereof in the transport direction are stacked on the alignment tray 207. The leading edges of the sheets are supported on the second discharge stacker 201.

The alignment tray 207 is provided with aligning means (not shown) for aligning the trailing edge of the sheets and finishing means composed of a stapler 216 for binding the sheets aligned by the aligning means. A variety of aligning means and finishing means are known, and any of the means can be applied to the invention. For example, the aligning means may be formed of a width aligning plate disposed on the alignment tray 207 and movable reciprocally in a direction perpendicular to the discharge direction of the sheets for abutting against the edges of the sheets. A pulse motor rotates a rack connected to the width aligning plate and a pinion connected to the rack in forward and reverse directions, so that the sheets on the alignment tray 207 are aligned neatly.

The finishing means (stapler apparatus 216 in the embodiment) is formed of a device main body for storing a band of staples formed of straight staples bonded together with an adhesive; a bending block for bending the band of staples into a U-shape staple; a forming member for pressing the staple against the bending block to deform the staple; a driver member for driving the staple bent into a U-shape into the sheets; and an anvil member for bending ends of the staple. The driver member, bending block and forming member are attached to a movable frame, and the anvil member is attached to a fixed frame. The movable frame and the fixed frame are arranged to move toward and away relative to each other. After the staple is formed into a U-shape and driven through the sheet bundle, the movable frame is driven toward the fixed frame with a drive motor through a drive cam, so that the anvil member bends the ends of the staple.

Figure 3:
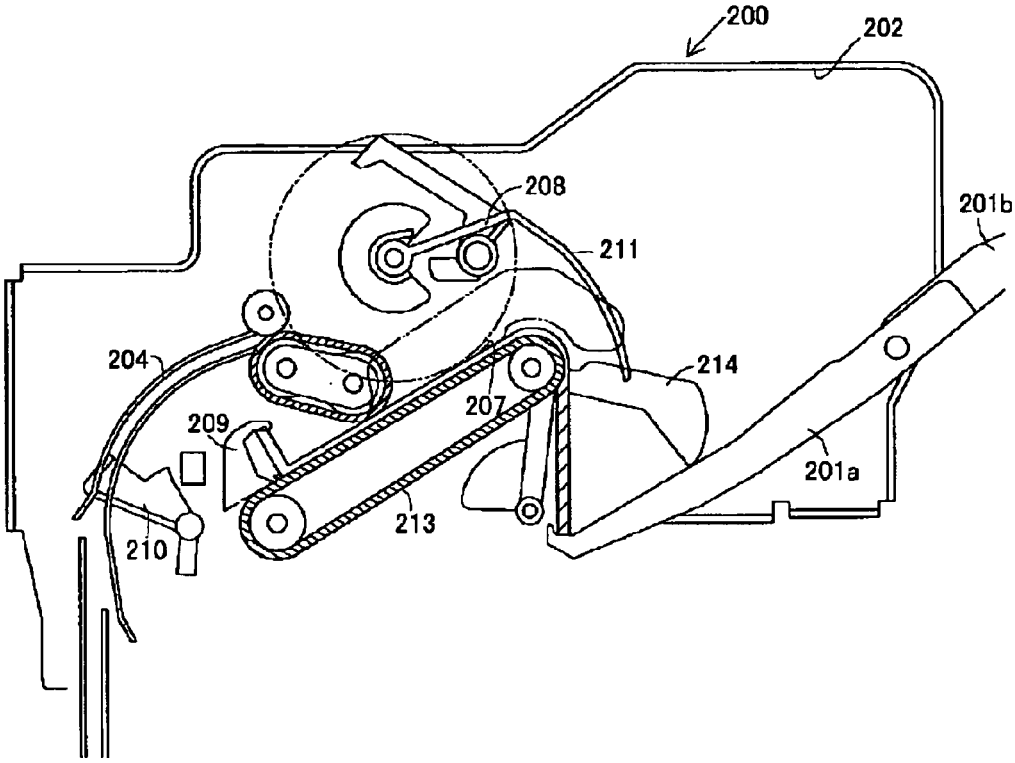
FIG. 3 is a view showing a discharge unit of a sheet finishing unit according to the embodiment of the present invention.

As shown in FIG. 3, a pushing member 209 formed of a protruding piece is disposed at the center of the alignment tray 207 to be movable in the left and right directions for transporting the sheets stacked on the alignment tray 207 to the discharge stacker after the sheets are stapled. The pushing member 209 is fastened to an endless belt 213 disposed below the alignment tray 207. When the endless belt 213 moves reciprocally in the left and right directions in FIG. 3, the sheet bundle on the alignment tray 207 is transported and stored on the second discharge stacker 201. Accordingly, the discharge means formed of the discharge roller 205, the discharge belt 206, and the pushing member 209 discharges the sheets with the maximum size in the longitudinal direction thereof from the left to the right in FIG. 3 through the discharge outlet 105.

A sensor 210 is provided in the path 204 for detecting the leading edge of the sheet passing through the path 204 according to a signal triggered by actions of the paddle 208 and pushing member 209. A pushing lever 214 is provided for pushing the sheet bundle stored on the stacker 201. When the sheet bundle is discharged, the pushing lever 214 moves upwardly from a state shown in FIG. 3. After the sheet bundle is stored, an urging spring urges the pushing lever 214 in the clockwise direction in FIG. 3 to push the uppermost sheet downwardly as shown in FIG. 3. Reference numeral 211 represents a full sensor.

As described above, the first discharge stacker 102 is disposed in the image forming unit 100 for storing the sheets, and the second discharge stacker 201 is arranged vertically above the first discharge stacker 102 for storing the sheets processed with the sheet finishing unit 200. The first discharge stacker 102 and the second discharge stacker 201 have a size capable of supporting the maximum size sheet in the longitudinal direction thereof, and have a width same as the lateral length of the maximum size sheet or slightly longer. At the same time, the casing 101 of the image forming unit 100 and the casing 202 of the sheet finishing unit have a width slightly longer than a length of the image reading unit 300 in the longitudinal direction of the original.

Figure 4:
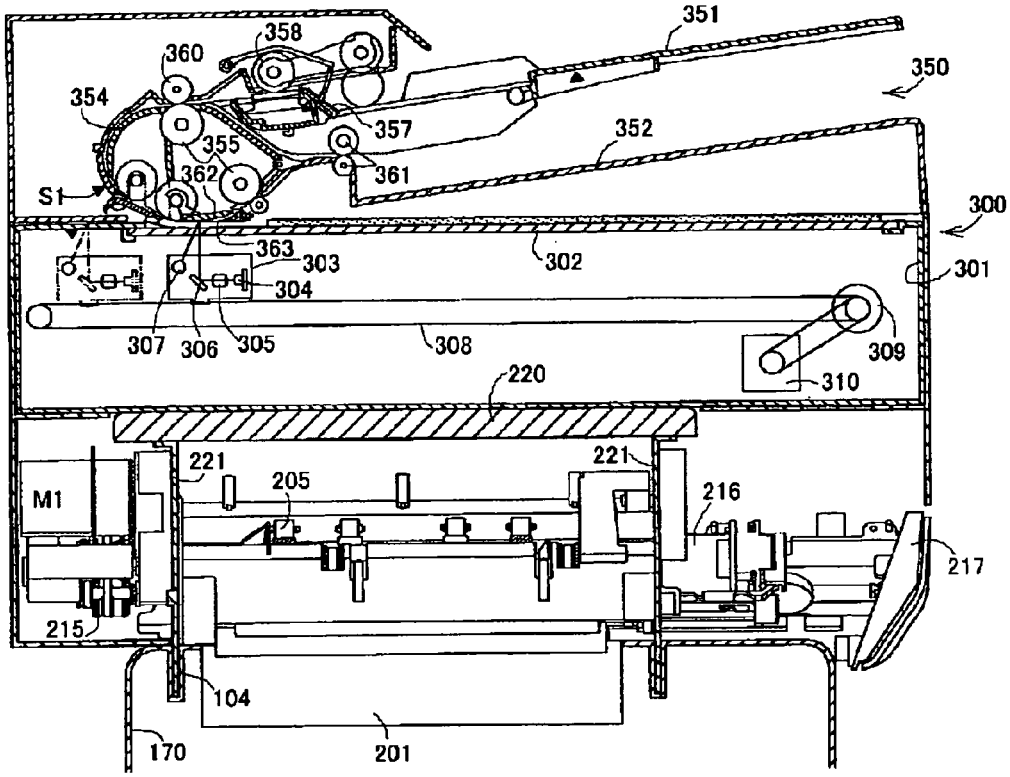
FIG. 4 is a view showing a sheet finishing unit, an image reading unit and a sheet finishing unit according to the embodiment of the present invention.
Figure 5:
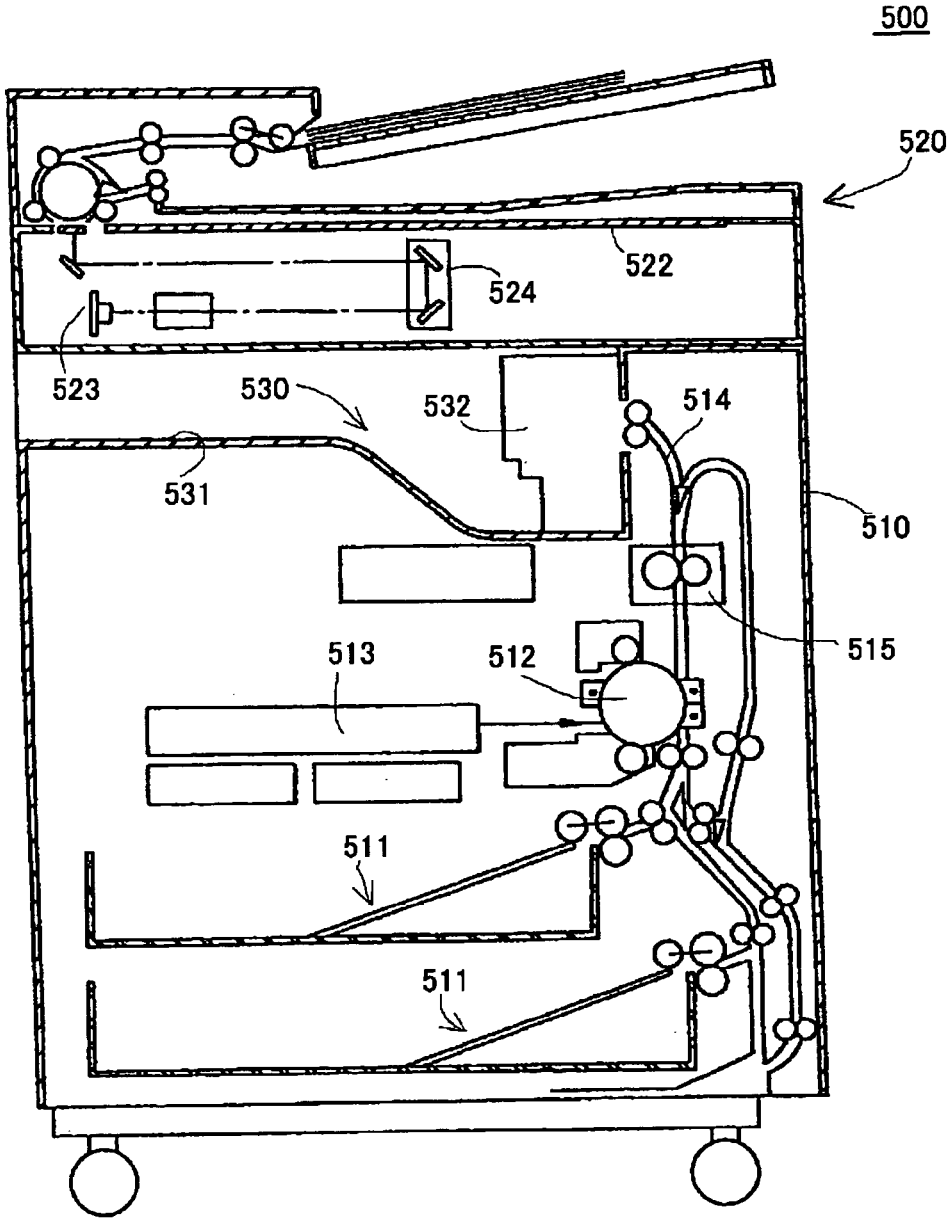
FIG .5 Prior Art
FIG. 5 is a view showing a conventional apparatus.
Figure 6:
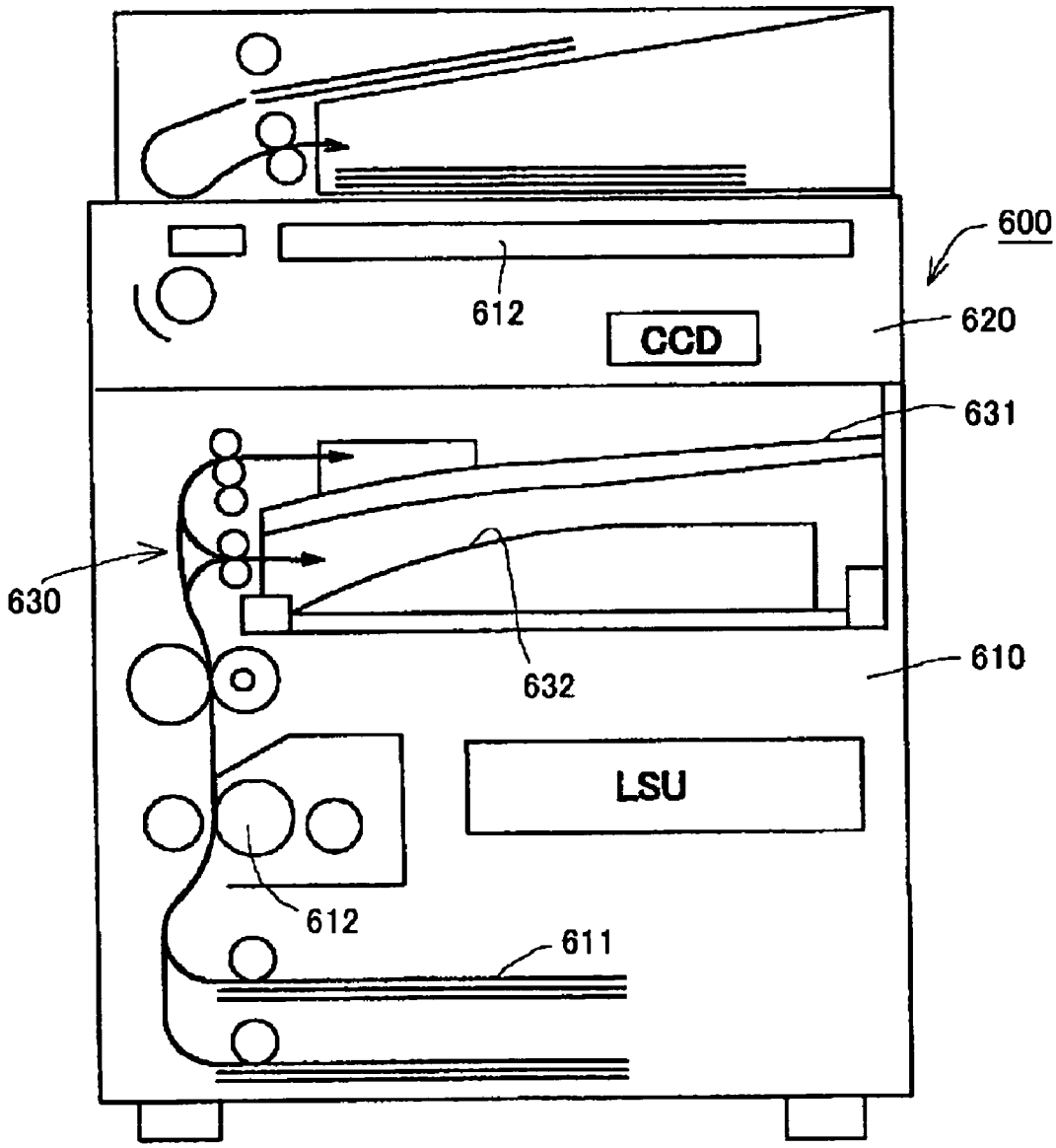
FIG. 6 Prior Art
FIG. 6 is a view showing another conventional apparatus.

As shown in FIG. 4, the casing 202 of the sheet finishing unit 200 has a width substantially same as that of the image reading unit 300 (described below). A drive mechanism and the finishing mechanism are arranged at left and right sides of the stacker 201 (lateral direction of the maximum size sheet). As shown in FIG. 4, a drive motor M1 for driving the discharge roller 205, discharge belt 206 and endless belt 213, and a transmission deceleration gear 215 connected to the drive motor are arranged on the left side of the discharge stacker 201. The stapler 216 and a drive motor for driving the stapler 216 are arranged on the right side of the discharge stacker 201. Reference numeral 217 represents an opening and closing cover for replacing a staple cartridge.

As shown in FIG. 4, the image reading unit 300 is mounted on the sheet finishing unit 200. The image reading unit 300 is formed of the casing 301; the platen 302 for setting the original; the carriage 303 moving along the platen 302; a photoelectric conversion element 304 mounted to the carriage 303; an optical lens 305 for guiding the light reflected from the original to the photoelectric conversion element 304; and a light source 307. The light from the light source 307 is reflected at the original on the platen 302. The reflected light is guided to the optical lens via the mirror 306. The image of the original is electrically read by the photoelectric conversion element 304.

The photoelectric conversion element 304 includes a variety of devices, and a CCD (charge-coupled device) is used in the embodiment. The CCD is formed of one (for black and white) or a plurality of line sensors (for color), and collects the light from the original and outputs an electrical signal to an external unit as a clock signal. The carriage 303 is mounted on a rail-shaped support member to be movable in the left and right directions in the FIG. 4. A reversible motor 310 connected to a timing belt 308 and pulley 309 moves the carriage 303 reciprocally. Accordingly, the CCD moves a sub-scanning direction (moving scanning direction), i.e. the left and right directions in FIG. 4, and a direction perpendicular to the sub-scanning direction is a main scanning direction.

The platen 302 of the image reading unit 300 is arranged substantially perpendicular to the first and second discharge stackers 102 and 201. That is, the stackers 102 and 201 are arranged along the longitudinal direction of the maximum size sheet (maximum size original in the image reading unit). The platen 302 is arranged in a direction perpendicular to the longitudinal direction. In the embodiment, the original feeding unit 350 is mounted on the image reading unit 300 for sequentially feeding and setting (stationary) the original on the platen 302.

The original feeding unit 350 is arranged vertically along with the sheet tray 351 and discharge tray 352. When the original is transported in a U-shape at a constant speed from the sheet tray 351 to the discharge tray 352, the photoelectric conversion element 304 mounted on the carriage reads the original. The carriage 303 with the photoelectric conversion element 304 is stationary at a position shown by solid lines in FIG. 4, and the photoelectric conversion element 304 reads the original passing over the platen 302 at a constant speed. The original feeding unit 350 is composed of a casing 353, an original circulating path 354, and pairs of transport rollers 355 disposed at appropriate positions along the original circulating path 354 (three pairs in the embodiment).

A kick roller 358 draws the uppermost original stacked on the sheet tray 351, and separating means 357 (kick roller 358 and a separation pad pressing against the kick roller 358) separates the originals into a single sheet. A register roller 360 aligns the leading edge of the original (to remove skew), then the original is sent to the circulating path 354. The original from the circulating path 354 is sent from the discharge rollers 361 to the discharge tray 352. After the leading edge of the original is sent to the discharge tray 352, the discharge rollers 361 rotate in the reverse direction to send the trailing edge of the original to the register roller 360 to switch over the original from front to back in the circulating path 354, so that the back side of the original is read in the reading unit 362.

A backup plate 363 is disposed in the original reading unit, and is formed of a plate shaped member for forming a small gap between the platen 302 to support the original so that the original is controlled when transported.

The platen 302 in the original feeding unit 350 is arranged in a direction same as the longitudinal direction of the maximum size original, and is arranged substantially perpendicular to the first and second stackers 102 and 201. In other words, the image forming unit (apparatus) and the sheet finishing unit (apparatus) are arranged in the direction same as the longitudinal direction of the maximum size original. The image reading unit (apparatus) and the original feeding unit are arranged such that the longitudinal direction of the maximum size sheet is perpendicular to the discharge direction. Accordingly, it is possible to make the apparatus small without the processing mechanism of the sheet finishing unit (apparatus) protruding outside of the apparatus.

Note that the functioning units, i.e. the image forming unit, the sheet finishing unit, the image reading unit and the original feeding unit, may be arranged in a same casing. As in the embodiment, it is possible that each of the functioning units is housed in a different casing as an independent apparatus, or that the image forming unit and the sheet finishing unit are arranged in the same casing as a single apparatus.

With the configuration described above, it is possible to use the image forming unit as an output apparatus for a computer, as a copier through adding the image reading unit, or as a system for automatically binding, punching holes or applying marks to the sheet bundle through adding the finishing unit. When each of the units is combined, it is preferred that an operator can combine the units from a front side of the apparatuses. In the embodiment, the operator can operate an operation panel of the image forming unit 100 (not shown) and remove the sheet from the first discharge stacker 102 and second discharge stacker 201 from the front side of the apparatuses, i.e. the right side in FIG. 1.

As shown in FIG. 2, the image forming unit 100 and the discharge stacker in the sheet finishing unit 200 are arranged such that the front operating sides thereof (right side in FIG. 2) are substantially aligned vertically. The image reading unit 300 and the original feeding unit 350 are shifted (offset) toward the backside by an amount L as shown in FIG. 2. In the embodiment, the amount L of the offset is set to be 200 mm. Accordingly, it is possible to minimize a gap between the first and the second discharge stackers 102 and 201, and to open the second stacker 201 in the offset space of the image reading unit so that the sheet is easily removed from the first discharge stacker 102.

Also, the image reading unit 300 arranged at the upper side is shifted, so that it is easy to view the sheets stored on the first and the second discharge stackers from the front side. When the image reading unit 300 is shifted from the image forming unit and the sheet finishing unit toward the backside (rear side) from the operation side (front side), it is possible to cause a problem in which the apparatus becomes unstable or the image reading unit 300 is not securely supported.

In the embodiment, a metal support frame 220 protruding toward the rear side is attached to the sheet finishing unit 200. The support frame 220 has a pair of stems 221 on the left and right sides thereof. The stems 221 are attached to the frame 170 of the image forming unit 100. Reference numeral 104 represents mounting holes for the stems 221.

An operation of the apparatus will be described next. The image forming unit 100 is electrically connected to a data generating unit such as a computer, and forms an image on the sheet based upon a data signal received from the data generating unit. The computer sends a printing signal and a command signal such as a sheet size. The sheet is drawn from a specified cassette 110 (one cassette in the embodiment, but a plurality of cassettes may be installed), and the leading edge of the sheet is aligned at the register roller 132. At the same time, the laser generator forms a latent image on the transfer drum in the printing unit 140 based on the data signal from the computer, and the toner ink is applied in the developer.

When the image is formed on the transfer drum 140, the sheet is moved into a transfer charger unit where the toner ink on the drum 140 is transferred to the sheet. The fixer roller 150 applies heat and pressure to the sheet, and the sheet is transported toward the discharge path 160.

When an operation without the finishing process is selected through the operation panel on the image forming unit or computer, the switching gate 170 in the discharge path 160 is in a state shown in FIG. 2, so that the sheet is transported and stacked on the first discharge stacker 102 through the discharge outlet 103. Accordingly, the operator can easily see the sheet stacked on the first discharge stacker 102 from the front side, and can remove the sheet when necessary. When a sheet jam occurs in the discharge outlet 103, the second discharge stacker 201 arranged above the discharge outlet 103 is rotated to the position indicated by hidden lines in FIG. 2 to deal with the sheet jam.

When an operation with the finishing process such as stapling is selected, the switching gate 170 in the discharge path 160 is rotated by a predetermined angle in the counterclockwise direction from the state shown in FIG. 2, so that the path 160 is connected to the path 204 in the sheet finishing unit 200. Accordingly, the sheet is guided into the path 204. After the inlet sensor 210 detects the leading edge of the sheet, the sheet is transported to outside of the apparatus through the discharge outlet 105. The sheet is sent to the alignment tray 207 through the discharge outlet 105, and to the discharge stacker 201, so that the sheets are sequentially stacked on the discharge stacker 201.

In the process of transporting the sheet, the paddle 208 guides the trailing edge of the sheet between the discharge belt 206 and the alignment tray 207 at an appropriate timing of a signal from the inlet sensor 210, so that the trailing edge of the sheet is stacked on the alignment tray 207. The aligning means abuts against the side edges of the sheet stacked on the alignment tray 207 to align the sheet.

When the image forming unit 100 sends an end signal indicating the last sheet, the binding (stapling) apparatus 216 starts to staple the sheets on the alignment tray 207. When the stapling process is completed, the transport belt 213 rotates to move the pushing member 209 connected to the transport belt 213 in the right direction in FIG. 3 to store the stapled sheet bundle on the discharge stacker 201. In the embodiment, in addition to the stapling processes (for binding sheets) described above, the hole punching process or marking process is performed in the same way.

An operation of the image reading unit 300 will be described next. The image reading unit 300 is connected to the image forming unit or a memory device such as a computer. The photoelectric conversion element 304 electrically reads the image on the original set on the platen 302, and sends the image to the memory device (not shown). When the original is set on the platen 302 and the start button is pressed, the carriage 303 moves to the right side in FIG. 4 from a home position indicated by hidden lines to read the original placed on the platen 302. An AD converter converts the data from an analog signal to a digital signal, and the data is stored in a memory device.

When the original feeding unit 350 is used, the original feeding unit 350 is mounted on the image reading unit 300 and the original is set on the sheet supply tray 351. When the start button is pressed, the kick roller 356 rotates to sequentially draw out the uppermost sheet. The sheet feed roller 358 and the separation pad 351 separate the sheets into a single sheet. The sheet idles at a position of the register roller 360.

At this time, the carriage 303 in the image reading unit 300 is stationary at a position indicated by solid lines as shown in FIG. 4. After a predetermined amount of time after the start button is pressed, the register roller 360 rotates to feed the original toward the reading unit. With the signal from the detection sensor S1, it is determined that the leading edge of the original is at the reading starting position, and the electrical signal from the photoelectric conversion element 304 is stored in the memory device.

In the image forming unit 100, the sheet is transported in the longitudinal direction of the maximum size sheet from the sheet cassette 110 to the printing unit 140, and to the discharge stacker 102 in this order. Accordingly, the transport path 130, printing means 140 and fixing roller 150 can be disposed in the width direction of the sheet, thereby making the apparatus compact. The sheet finishing unit 200 can be arranged in the same way.

In the image reading unit 300, the platen 302 for placing the maximum size original is arranged in a direction substantially perpendicular to the first and second discharge stackers 102 and 201. Accordingly, it is possible to remove the sheet from the first and second discharge stackers 102 and 201, and set the sheet on the platen 302 from the same side (front side).

As described above, in the image forming apparatus according to the embodiment of the present invention, the sheet is transported from the image forming unit in the direction same as the direction that the sheet is transported from the sheet finishing unit arranged above the image forming unit. The image reading unit scans the sheet in the direction substantially perpendicular to the direction that the sheet is transported, thereby making the image forming apparatus compact with little protrusions of the overall apparatus.

It is also easy to check the sheet stored on the discharge stackers in the image forming unit and the sheet finishing unit arranged vertically from the same direction.

While the invention has been explained with reference to the specific embodiments of the invention, the explanation is illustrative and the invention is limited only by the appended claims.

What is claimed is:

1. An image forming apparatus comprising:

an image forming unit for forming an image on a sheet including a first discharge stacker for stacking the sheet, and first sheet discharge means for discharging the sheet in a discharge direction to the first discharge stacker, a sheet finishing unit arranged above the image forming unit for performing a finishing process on the sheet discharged from the image forming unit, said sheet finishing unit including a second discharge stacker for stacking the sheet, and second sheet discharge means for discharging the sheet in a direction same as the discharge direction, and an image reading unit for scanning an original set on a platen, said image reading unit being arranged above the sheet finishing unit such that a scanning direction thereof is substantially perpendicular to the discharge direction, wherein said sheet finishing unit is provided with a mounting member for mounting the image reading unit on the sheet finishing unit, said mounting member having a support portion protruding from the sheet finishing unit toward a backside relative to the discharge direction.

2. An image forming apparatus according to claim 1, wherein said image reading unit is arranged at a position shifted relative to the first discharge stacker and the second discharge stacker toward a backside relative to the discharge direction.

3. An image forming apparatus according to claim 1, wherein said image forming unit, said sheet finishing unit, and said image reading unit are retained in separate casings, respectively.

4. An image forming apparatus according to claim 1, wherein said sheet finishing unit further includes finishing means arranged on one of a left side and a right side of the second discharge stacker, and said second sheet discharge means includes drive means arranged on the other of the left side and the right side of the second discharge stacker.

5. An image forming apparatus according to claim 1, wherein said supporting portion includes a flat portion for mounting the sheet finishing unit and at least two stems connected to the flat portion.

6. An image forming apparatus according to claim 1, wherein said image reading unit includes an original feeding unit for feeding the original in the scanning direction.

7. An image forming apparatus according to claim 1, wherein said sheet finishing unit includes at least one means for punching a hole, stapling and marking on the sheet.

8. An image forming apparatus comprising:

an image forming unit for forming an image on a sheet including a first discharge stacker for stacking the sheet, and first sheet discharge means for discharging the sheet in a discharge direction to the first discharge stacker, a sheet finishing unit arranged above the image forming unit for performing a finishing process on the sheet discharged from the image forming unit, said sheet finishing unit including a second discharge stacker disposed with a space above the first discharge stacker to overlay therewith for stacking the sheet, and second sheet discharge means for discharging the sheet in a direction same as the discharge direction, said second discharge stacker being supported to rotate upwardly to open an upper part of the first discharge stacker, and an image reading unit for scanning an original set on a platen disposed on the sheet finishing unit, said image reading unit being arranged above the sheet finishing unit such that a scanning direction thereof is substantially perpendicular to the discharge direction and being offset rearwardly from the first and second discharge stackers relative to the discharge direction.

9. An image forming apparatus according to claim 8, wherein said second discharge stacker includes a fixed base portion, and a leading end portion rotatably attached to the base portion.

10. An image forming apparatus according to claim 9, wherein front sides of the sheet finishing unit and the image reading unit are spaced rearwardly from a front side of the image forming unit, and the leading end portion of the second discharge stacker protrudes from a casing of the sheet finishing unit toward the front side of the image forming unit.

* * * * *